US007090631B2

(12) United States Patent
Boss

(10) Patent No.: US 7,090,631 B2
(45) Date of Patent: Aug. 15, 2006

(54) METHODS AND APPARATUS FOR SCORING AND TRIMMING IMAGED SHEET MEDIA

(75) Inventor: Roland Boss, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/764,767

(22) Filed: Jan. 26, 2004

(65) Prior Publication Data

US 2004/0154485 A1 Aug. 12, 2004

Related U.S. Application Data

(62) Division of application No. 09/992,245, filed on Nov. 14, 2001, now abandoned.

(51) Int. Cl.

| | |
|---|---|
| ***B31B 1/14*** | (2006.01) |
| ***B31B 49/00*** | (2006.01) |
| ***B31F 5/02*** | (2006.01) |
| ***B31F 7/00*** | (2006.01) |

(52) U.S. Cl. ..... 493/367; 493/353; 493/359; 493/365; 493/366; 493/368

(58) Field of Classification Search ..... 493/396, 493/397, 399, 402, 403, 405, 359, 360, 365, 493/366, 367, 352, 356, 353, 368
See application file for complete search history.

(56) References Cited

U.S. PATENT DOCUMENTS

| | | | | |
|---|---|---|---|---|
| 225,506 | A * | 3/1880 | Chambers et al. | 493/429 |
| 4,691,908 | A * | 9/1987 | Bradley | 270/21.1 |
| 5,417,642 | A * | 5/1995 | Boronka et al. | 493/425 |
| 5,547,452 | A * | 8/1996 | Kepert et al. | 493/427 |
| 5,707,330 | A | 1/1998 | Kiamco et al. | |
| 5,921,906 | A * | 7/1999 | Nagano | 493/353 |
| 6,026,727 | A * | 2/2000 | Meeks | 83/887 |
| 6,234,947 | B1 * | 5/2001 | Michalik | 493/425 |
| 6,296,601 | B1 * | 10/2001 | Couturier | 493/365 |
| 6,460,439 | B1 * | 10/2002 | Belanger | 83/13 |
| 6,604,444 | B1 * | 8/2003 | Belanger et al. | 83/155 |

FOREIGN PATENT DOCUMENTS

| | | |
|---|---|---|
| DE | 4207209 A1 | 9/1993 |
| DE | 19721913 A1 | 2/1998 |
| FR | 413458 | 3/1910 |
| GB | 606207 | 12/1946 |

* cited by examiner

*Primary Examiner*—John Sipos
*Assistant Examiner*—Christopher R. Harmon

(57) ABSTRACT

A sheet finishing apparatus includes a media path configured to receive a sheet of media moving along the media path. A creasing tool is located proximate to the media path and is configured to form a crease in the sheet of media. The apparatus also includes a sheet folding device configured to fold the sheet of media along the crease. The creasing tool is preferably configured to operably move from a first position wherein the creasing tool is retracted away from the media path, to a second position wherein the creasing tool can contact a sheet of media moving along the media path and thereby form a crease in the sheet.

12 Claims, 14 Drawing Sheets

METHODS AND APPARATUS FOR SCORING AND TRIMMING IMAGED SHEET MEDIA

CROSS REFERENCE TO RELATED APPLICATIONS

This application is a divisional application under 35 U.S.C. § 120 of U.S. patent application Ser. No. 09/992,245, filed Nov. 14, 2001 now abandoned, which is hereby incorporated by reference herein in its entirety.

FIELD OF THE INVENTION

The invention claimed and disclosed herein pertains to methods and apparatus for folding and/or trimming a sheet of media, such as paper, in a document production apparatus.

BACKGROUND OF THE INVENTION

Apparatus known as "document production apparatus" are generally configured to process one or more sheets of media (such as paper) to thereby form the media into a finished document. Some document processing apparatus can bind a plurality of sheets into a single document. Other document production apparatus can include a sheet folding device that can fold a sheet of media, such as paper, into a bi-fold, tri-fold, or other multi-folded pamphlet. For example, FIG. 1 depicts a tri-fold pamphlet 10 formed from a single sheet of media "M". The sheet "M" is folded along a first fold line 18 which segregates the sheet "M" into portions 12 and 14. The sheet "M" is further folded along a second fold line 20 which further segregates the sheet "M" into portions 14 and 16. Document processing apparatus having sheet-folding capability are known in the art. (See, for example, U.S. Pat. No. 6,132,352, incorporated herein by reference.)

Also known are document production apparatus which incorporate a trimming or cutting device which can cut or trim media to a desired size. (See, for example, U.S. Pat. Nos. 5,527,567 and 5,708,345, which are both incorporated herein by reference.) Such trimming and cutting devices allow media to be provided from a continuous roll of media, and also allow a document to be trimmed to a desired size after imaging.

Some prior art apparatus used to fold a sheet of media into a multi-fold pamphlet typically incorporate a pinch bar or pinch roller (a "pinch device") which urges a portion of the sheet, along which a fold is to be formed, towards a pair of counter-rotating fold-forming rollers. For purposes of the following discussion, I will define the line along which a fold is to be formed in a sheet of media as the "intended fold line", and the line along which the actual fold is formed as the "fold line". The counter-rotating rollers, which are preferably in contact with one another and are aligned along parallel axes, then engage the sheet in the area of the intended fold line. The area in which the counter-rotating rollers (the "fold rollers") engage the sheet is known as the "nip". As the sheet passes through the fold rollers, the sheet is folded along the fold line. The sheet can then be passed through another set of fold rollers, or passed back though the original set of fold rollers, to form additional folds in the sheet. This is graphically demonstrated in FIG. 2, which shows a side elevation view of a sheet of media "M" being folded into leaves 31 and 33. The actual fold line will generally be located in the area 38. A pinch roller 30 moves in direction "A" to move the fold area 38 towards the nip 36 and into the counter-rotating fold rollers 32 and 34. The fold rollers 32 and 34 grasp the sheet "M" as it is urged into the rollers, and thereby folds the sheet "M" into a bi-fold sheet.

Such prior art apparatus sheet folding apparatus present several deficiencies. First, the pinch bar does precisely direct the intended fold line towards the nip, but only approximates the position of the intended fold line. This is demonstrated in FIG. 2, where the actual fold line will be formed in the fold area 38, but is not clearly defined in this fold area. As a result, the actual fold can be formed in a slightly different location on the sheet than the desired fold line. In addition to the actual fold line not being coincident with the intended fold line, the actual fold line can also be skewed with respect to the intended fold line. This is demonstrated in FIG. 3, which shows a sheet of media "M" which is intended to be folded into two equal parts along the intended fold line 44, but in fact is folded along the actual fold 42, which is offset at a slight angle to the intended fold line 44. The result it that when the first half 46 of the sheet "M" is folded over the second half 48 of the sheet, the first edge 31 will not align with the second edge 33, providing a visually unattractive pamphlet.

In other prior art sheet folding apparatus, rather than use a pinch bar to move the document into the fold rollers, a stop device is used to stop forward progress of the sheet. Since the sheet is still being fed by feed rollers, the sheet will be caused to buckle and move into the fold rollers. This results in the fold being formed along a rather imprecise line, since the area where the sheet will buckle can vary with the sheet thickness and other variables. Further, the use of a stop device generally limits the thickness of sheet media which can be used to form the folded pamphlet, since relatively thick sheets will tend to crumple rather than buckle.

Another problem occurs when the fold line passes through an image (such as text or graphics) on the sheet of media. In this event, folding the sheet along the fold line can cause small portions of the image in the fold area to separate from the sheet. This problem is particularly noted when the image is formed using a toner which is fused to the sheet to create the image.

A further problem with prior art sheet folding apparatus is that they generally require forward progress of the sheet media to be temporarily halted while the sheet media is moved into the nip of the fold rollers. When the sheets to be folded are being provided from an attached imaging device, this can determine the speed of the imaging device, since the sheet folding device generally will not be able to process sheets of media as quickly as the imaging device. Accordingly, anything which can be done to improved the speed at which sheets of media can be folded by the sheet folding device will generally allow the imaging device to operate closer to its design speed, thus improving the speed of the overall imaging-folding process.

What is needed then is a document processing apparatus which achieves the benefits to be derived from similar prior art devices, but which avoids the shortcomings and detriments individually associated therewith.

SUMMARY OF THE INVENTION

One embodiment of the present invention includes a sheet finishing apparatus having a media path configured to receive a sheet of media moving along the media path. The apparatus includes a creasing tool disposed proximate the media path and configured to form a crease in the sheet of media. The apparatus further includes a sheet folding device configured to fold the sheet of media along the crease.

Another embodiment of the present invention includes a document processing apparatus for folding or cutting a sheet of media. The apparatus includes a media path configured to receive a sheet of media which moves along the media path. A first roller, defined by a length and an outer surface, is disposed proximate the media path. The first roller has an elongated slot formed therein along at least a portion of the length parallel to axis of roller, and the slot opens to the outer surface of the roller. A knife, defined by an edge, is received within the elongated slot in the roller. The knife is configured to operably move from a first position wherein the edge of the knife is retracted away from the surface of the roller, to a second position wherein the edge of the knife protrudes outwardly from the surface of the roller. In the second position the knife edge can thereby contact a sheet of media moving along the media path to thereby either crease or cut the sheet.

A third embodiment of the present invention provides for a sheet finishing apparatus, which is preferably configured to be used in conjunction with a sheet imaging apparatus. The sheet finishing apparatus includes a media path configured to receive a sheet of media from the imaging apparatus. A drive mechanism is configured to move a sheet of media along the media path in a media path direction. An elongated member, defined by an edge, is oriented perpendicular to the media path direction. The elongated member is configured to operably move from a first position away from the media path to a second position wherein the edge of the elongated member can contact a sheet of media moving along the media path to thereby either crease or cut the sheet.

A fourth embodiment of the present invention provides for a method of folding a sheet of media. The method includes providing a sheet of media, and automatically forming a crease on the sheet of media. The cease is formed along a first crease line to thereby define first and second portions of the sheet, each portion of the sheet being defined by the first crease line. The sheet is then urged towards a nip by pressing the sheet of media essentially along the crease while supporting the first and second portions of the sheet. At the nip, the sheet is grasped at essentially the first crease line, and the first portion of the sheet is urged towards the second portion of the sheet, thereby forming a folded sheet of media.

These and other aspects and embodiments of the present invention will now be described in detail with reference to the accompanying drawings, wherein:

DETAILED DESCRIPTION OF THE INVENTION

The present invention provides methods and apparatus for processing a sheet of media. Specifically, the present invention can be used to facilitate folding of a sheet of media, and can also be used to cut or trim a sheet of media. By "sheet of media" I mean a sheet on which an image can be formed, as for example paper, a plastic transparency or cardstock. The present invention improves on prior art sheet folding methods and apparatus by forming a crease in the sheet at the intended fold position prior to folding the sheet. The crease allows the fold to be formed in a more precise location, and results in a visually more attractive fold over the prior art methods. Moreover, the sheet creasing and folding method of the present invention can be performed automatically, and can also be performed in-line, thus resulting in quicker processing of the sheet by an attached imaging device which feeds imaged sheets of media to the sheet folding device.

Figure 4:
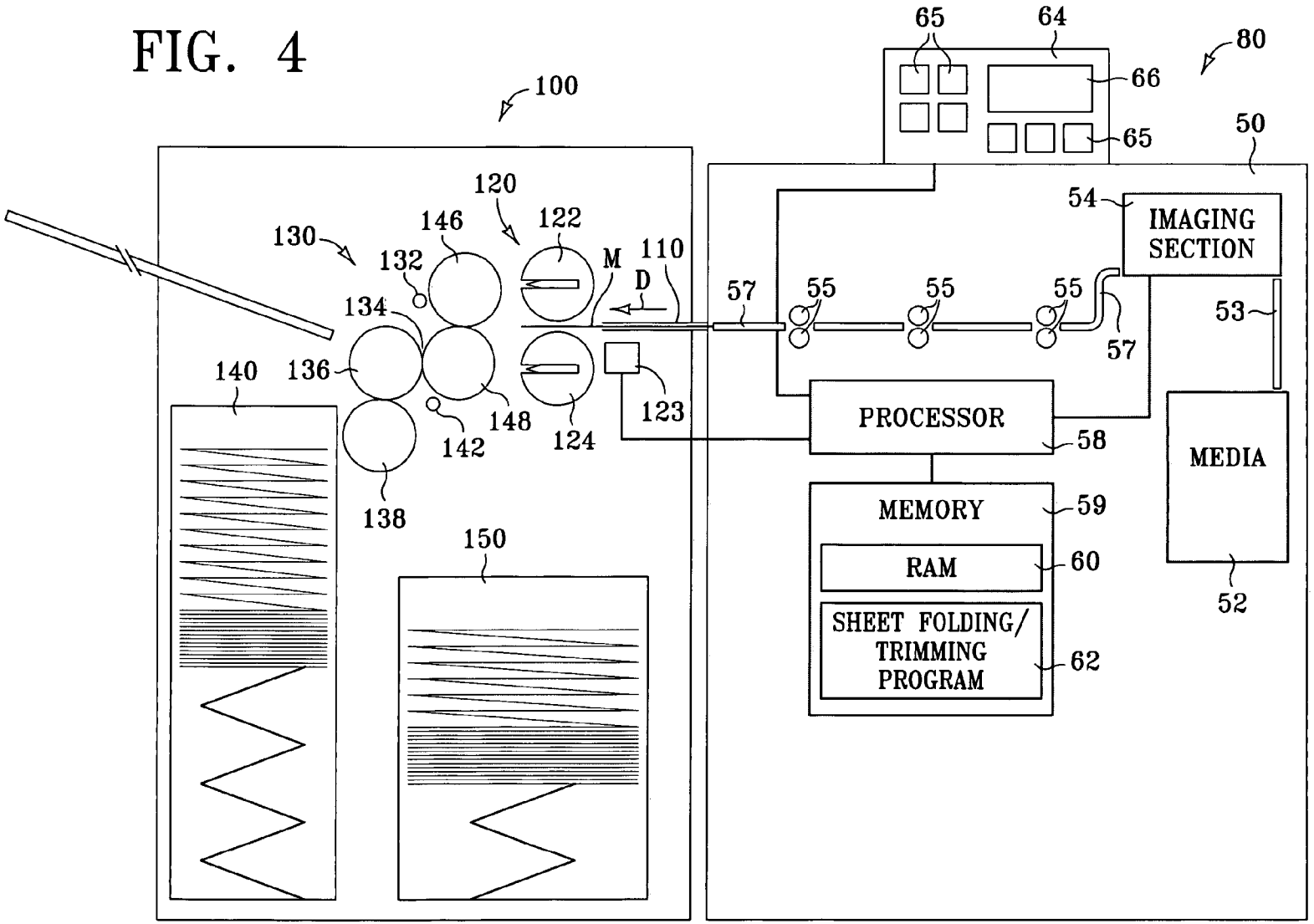
FIG. 4 is a side elevation diagram depicting a document processing apparatus in accordance with one embodiment of the present invention.

A first embodiment of the present invention is depicted in the side elevation schematic diagram of FIG. 4, which portrays a document processing apparatus 80 comprising an imaging apparatus 50 having an attached sheet finishing apparatus 100. The imaging apparatus 50 can be a printer or photocopier, for example. In the example shown, the imaging apparatus 50 is configured to move a sheet or media 52, such as a sheet of paper, along media path 53 and to the imaging section 54. The imaging section can be any known imaging section, such as an electrophotographic imaging section (commonly known as a "laser printer"), or an ink printing section, such as an ink-jet printer. The imaged media then is moved along media path 57 (using a drive mechanism such as powered rollers 55 or drive belts or the like) to the finishing section 100. The imaging apparatus 50 can include a processor 58 configured to control operation of the imaging apparatus 50, and can also be used to control operation of the sheet finishing section 100. A computer-readable memory device 59 can be provided to allow a data file of an image, which is to be printed on the media, to be temporarily stored, for example in the random access memory ("RAM") 60 portion of the memory device 59. The memory device 59 can also be used to store a sheet folding/trimming program 62, which can be used to control operation of the finishing section 100, as will be described further below. The imaging apparatus can also be provided with a user interface 64, which can include user input points (such as buttons or switches 65) allowing a user to provide instructions to the processor 58 to direct the imaging apparatus 50 to print images on sheets of media, and also to direct the finishing section 100 to apply finishing to the imaged media. The user interface 64 can also include a display 66 to allow the processor 58 to communicate information to the user, such as information regarding status of the imaging apparatus 50 and the finishing apparatus 100.

The sheet finishing apparatus 100 of the document processing apparatus 80 can be configured to apply one or more of several finishing processes to imaged media. For example, the finishing apparatus 100 can include a sheet binding device, such as a stapler or a stitching device. However, for purposes of the present discussion, we will assume that the sheet finishing apparatus includes only the sheet folding/trimming apparatus of the present invention. As depicted in FIG. 4, the finishing apparatus 100 includes a media path guide 110 configured to receive a sheet of media "M" from the imaging apparatus 50. The "media path", as I use the term herein, is not constrained to physical guides and the like for the sheet of media, but is intended to mean the path that a sheet of media can following in moving through the finishing apparatus 100. Media is moved in initial direction "D" into the media path in the finishing apparatus 100.

The finishing apparatus includes a pair of rollers 122 and 124 (which I will call "scoring rollers") which can be used to score, crease or cut the media, as will be explained further below. The finishing apparatus can further include a sheet folding device 130 configured to fold a sheet of media. The sheet folding device 130 can included powered drive rollers 146 and 148 to move the sheet into a first folding position. The folding device 130 further includes a first pinch device, such as pinch roller 132. The pinch roller 132 is configured to operably move from a first position away from the media path to a second position proximate the media path to thereby contact a sheet of media. The folding device also includes a first pair of fold rollers 136 and 148 which are used to fold the sheet of media, as follows. The scoring rollers 122 and 124 are configured to score or crease the media along a crease line (i.e., along an intended fold line), and the pinch roller 132 is configured to move from its first position to its second position and contact the sheet to initiate the folding of the sheet along the crease. The pinch roller 132 urges the crease formed in the sheet towards a first "nip" 134. (The "nip" is the area where the fold rollers 136 and 148 come together.) To form a first fold in a sheet of media, roller 136 rotates in a clockwise direction, and roller 148 rotates in a counter-clockwise direction. The rollers 136 and 148 grasp the sheet at the first crease and fold the sheet into two parts. The folded sheet can then be deposited in a bi-fold receiving compartment 150.

The folding device 130 can further include a second pinch roller 142 and a second pair of fold rollers 136 and 138. (Note that for simplicity of construction roller 136 forms a part of both the first fold rollers (136, 148) as well as the second fold rollers (136, 138), and drive roller 148 also forms a part of the first sheet folding rollers (136, 148).) The components for forming a second fold in a sheet of media operate in a manner similar to the components (132, 136, 148) described above. That is, a second pinch roller 142 moves to contact a second crease formed in a sheet of media and urge the crease towards a second nip 144, which is defined by second fold rollers 136 and 138. The second fold rollers grasp the sheet at the second crease and form a second fold in the sheet to create a tri-fold document. The tri-folded sheet can then be deposited in a tri-fold receiving compartment 140.

The sheet folding apparatus 100 can further include sensors 123 (only one of which is shown) to determine the presence of a sheet of media in the media path, as well as the rotary positions of scoring rollers 122 and 124. The sensors can include, for example, edge detectors to detect the absence or presence of a sheet of media in the media path, and thereby allow the processor 58 to determine when a leading edge of a sheet of media enters the scoring rollers 122 and 124. The sensors 123 can also include encoders which can be used to determine the number of rotations of feed rollers (such as rollers 55, 146 and 148), and thus allow the processor 58 to determine the position of a sheet in the media path. The use of such sensors to track the position of a sheet of media in a media path is well known in the art, and need not be discussed further herein. The information from the sensors 123 can be used by the processor 58 to direct the operation of the scoring rollers, as well as to operate a sheet folding device actuator (not shown) which is used to actuate the various components of the sheet folding device 130 described above. Specifically, the sensors 123 can be used to determine the location at which the scoring rollers will score or crease a sheet along a contact line (crease line), and this information can then be used by the processor 58 to determine when the contact line is oriented in a preselected position relative to the sheet folding device 130. More specifically, the processor will be able to determine when a crease formed in the sheet is oriented with respect to the pinch rollers 132 and 142 so that the pinch rollers can be moved to contact the sheet at the crease and urge the crease of the sheet into the respective nip (134 or 144). In this way, the functions performed by the sheet finishing apparatus 100 can be performed automatically, as will be further described below.

Figure 5A:
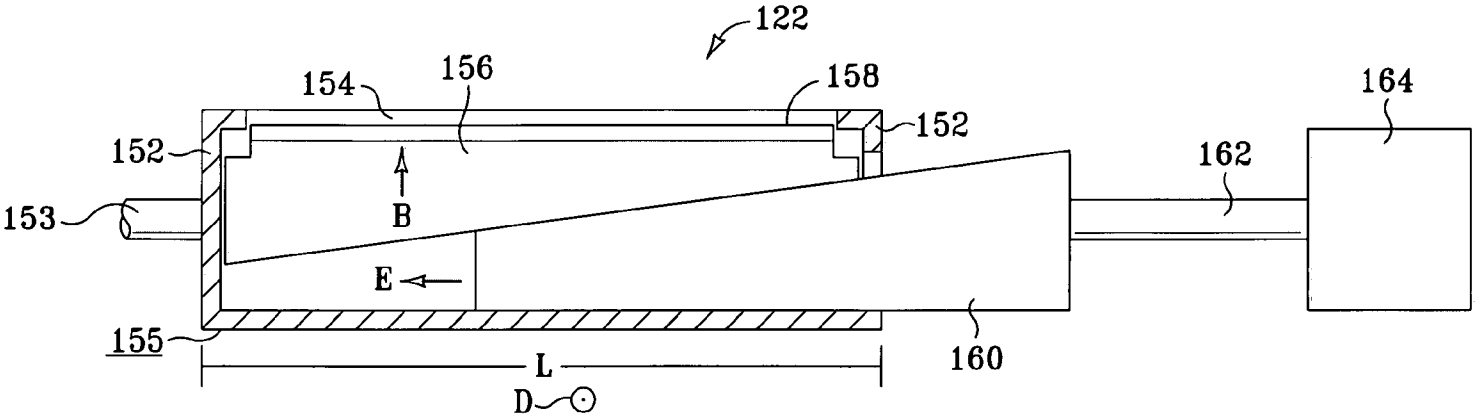
FIGS. 5A and 5B depict a side elevation sectional view of a roller in accordance with the present invention which includes a knife to crease or cut a sheet of media, showing the knife in two different positions.

Turning now to FIG. 5A, first scoring roller 122 of FIG. 4 is depicted in sectional front elevation view. The second scoring roller 124 can be configured similar to the first roller 122. The roller 122 is viewed in FIG. 5A from the front, whereas the roller is depicted in a side view in FIG. 4. Thus, media moves in direction "D" (i.e., out of the plane of the paper in which the figure is drawn) to move across the roller 122. The roller 122 is supported by a shaft 153 which can be used to drive the roller in a rotational direction using a drive mechanism such as a motor (not shown). In this way rotation of the roller 122 can be selectively actuated and stopped by connecting the roller drive mechanism to the processor 58 (FIG. 4). The roller 122 includes a body 152 which is defined by an outer surface 155. An elongated slot 154 is formed in the roller body 152 along a substantial portion of the length "L" of the roller. A first knife 156, in the form of an elongated member, is received within the slot 154. The first knife is defined by an edge 158, and is configured to operably move from a first position wherein the edge 158 is retracted away from the surface 155 of the roller 122, to a second position (see FIG. 5B) wherein the edge 158 protrudes outward from the surface 155. In this manner the knife edge 158 can contact a sheet of media moving along the media path "D". As is evident, the edge 158 of the knife 156 is oriented perpendicular to the media path "D". When the edge 158 of the knife 156 contacts the sheet of media, the sheet of media can either be scored (i.e., the edge 158 cuts slightly into the sheet of media), creased (i.e., the edge 158 causes a deformation in the sheet of media along a line coincident with the knife edge), or cut (i.e., the edge severs the sheet of media along the line of contact). I will use the expression "crease" and "score" interchangeably herein, unless expressly stated otherwise. The determination of whether the sheet of media will be creased (deformed), scored or cut will be dependent on (1) the thickness and type of media used for the sheet, (2) the depth to which the knife edge is moved relative to the sheet, (3) any object placed on the opposite side of the sheet and which causes the sheet to be trapped between the knife edge and the object, and (4) the geometry of the knife edge.

Figure 5B:
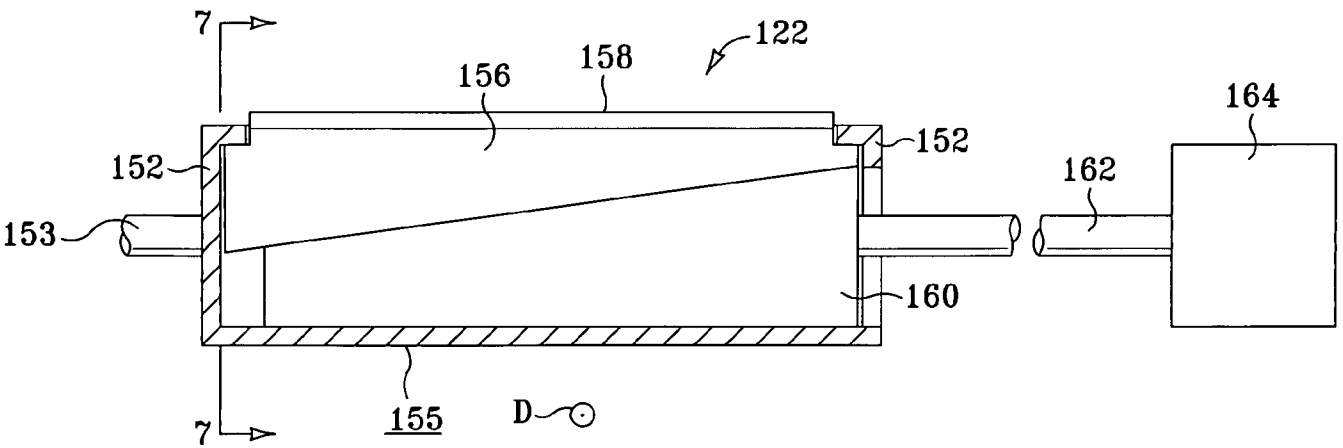
Figure 7:
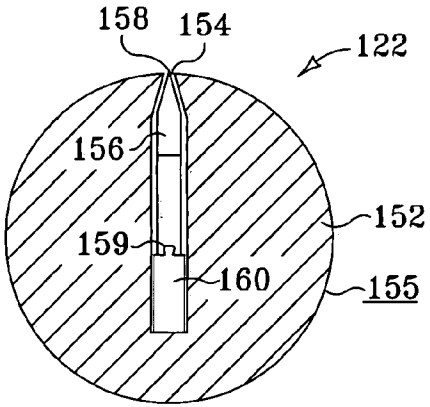
FIG. 7 is a side elevation sectional view of the roller depicted in FIG. 5B.

FIGS. 5A and 5B depict one configuration which can be used to deploy the knife 156 from the first position (FIG. 5A) to the second position (FIG. 5B). As shown, the roller 122 includes a cam 160 disposed within the elongated slot 154 and in contact with the first knife 156. The cam is configured to slidably move in direction "E" (and in the opposite direction) along a portion of the length "L" of the roller 122. In this way the knife 156 can be operably moved from the first position of FIG. 5A to the second position of FIG. 5B. In the position depicted in FIG. 5B, the knife edge 158 can contact a sheet of media and thereby score, crease or cut the sheet. Turning to FIG. 7, a side elevation section view of the roller 122 of FIG. 5B is depicted. The edge 158 of the knife 156 is shown protruding slightly beyond the outer surface 155 of the roller 122. Preferably, the knife 156 is attached to the cam 160 via a slidable connection 159 such that movement of the knife 156 is constrained by the position of the cam 160. This will help prevent the knife 156 from falling into the deployed position when the roller is rotated 180 degrees from the position depicted in FIG. 5A. That is, the connection between the knife 156 and the cam 160 ensures that the knife is selectively deployable, rather than being incidentally deployed when the roller 122 is in a position 180 degrees from that depicted in FIG. 5A.

Returning to FIG. 5A, the cam 160 can be connected to a knife actuator 164 via a connecting member 162. For example, knife actuator 164 can be a solenoid which can be used to push the cam 160 from the position depicted in FIG. 5A to the position depicted in FIG. 5B, and likewise to pull the cam from the position depicted in FIG. 5B to the position depicted in FIG. 5A. The connecting member 162 can be configured to freely rotate within the actuator 164, thus allowing the roller 122 to freely rotate. Alternately, the actuator 164 can be supported on a rotatable mounting. As will be more fully described below, the operation of the knife actuator 164 can be controlled by the processor (58, FIG. 4). In this way the knife 156 can be moved to the second position (FIG. 5B) in response to receiving an instruction to form a crease along an intended fold line on a sheet of media moving along the media path "D".

Figure 1:
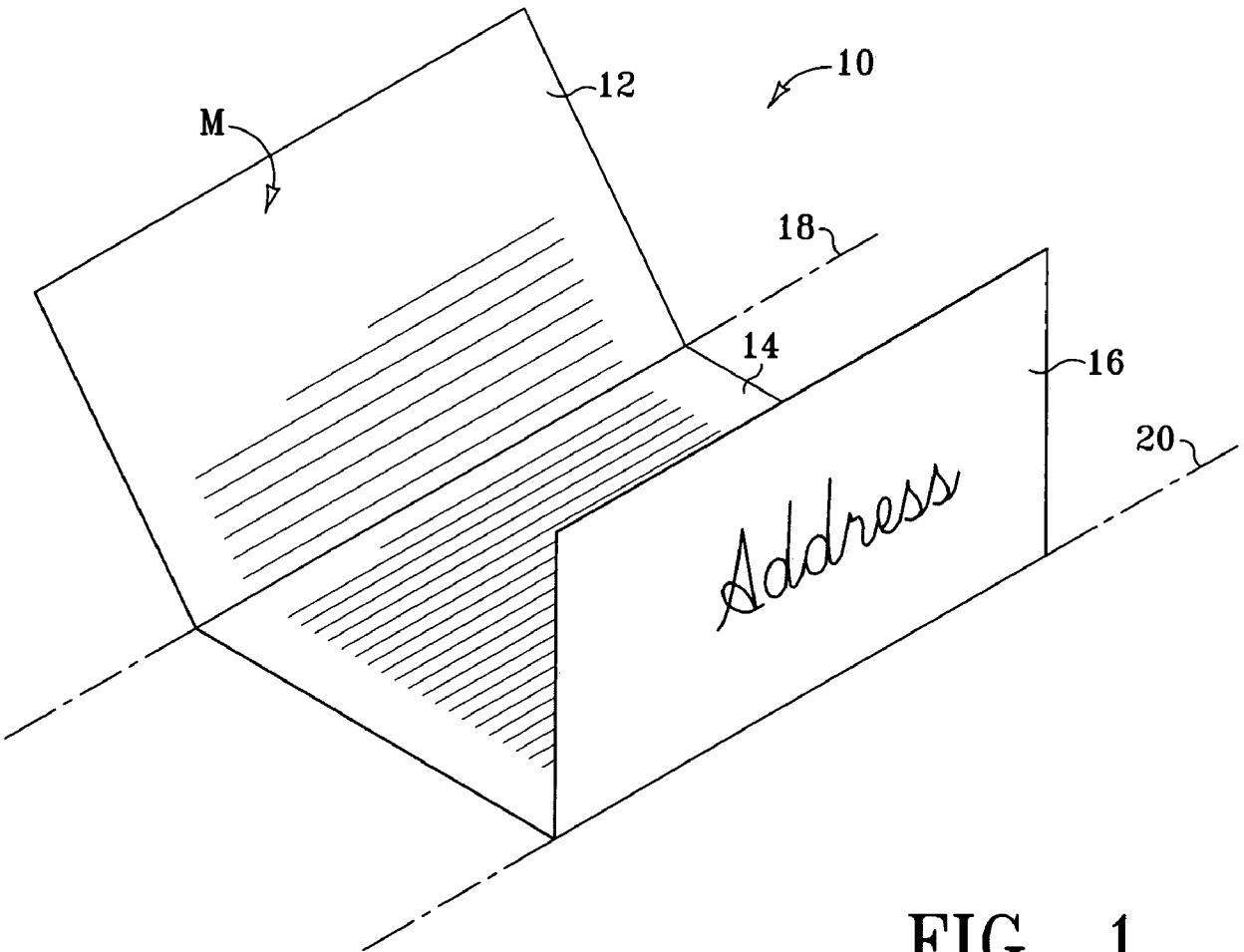
FIG. 1 (Prior Art)
FIG. 1 is an isometric diagram depicting a tri-fold pamphlet folded from a sheet of media.
Figure 3:
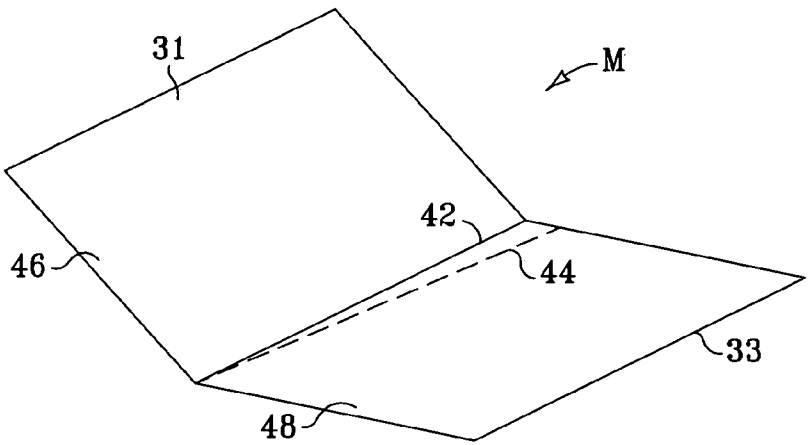
FIG. 3 (Prior Art)
FIG. 3 is an isometric view of a sheet of media which is folded by an apparatus of the prior art.
Figure 2:
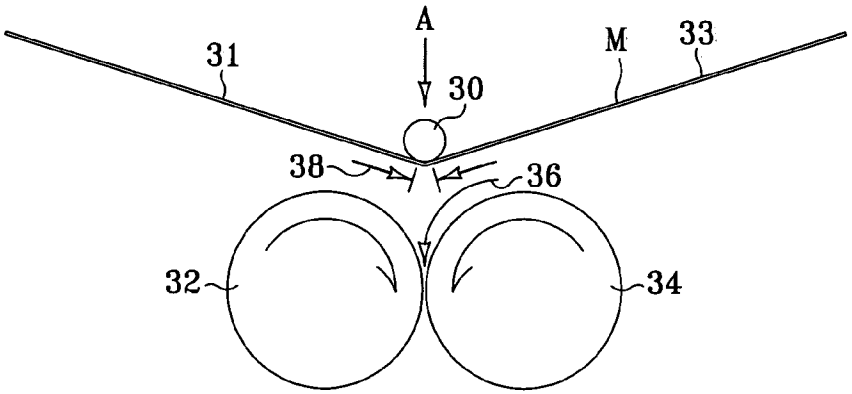
FIG. 2 (Prior Art)
FIG. 2 is a side elevation schematic diagram depicting a sheet folding mechanism of the prior art.
Figure 6B:
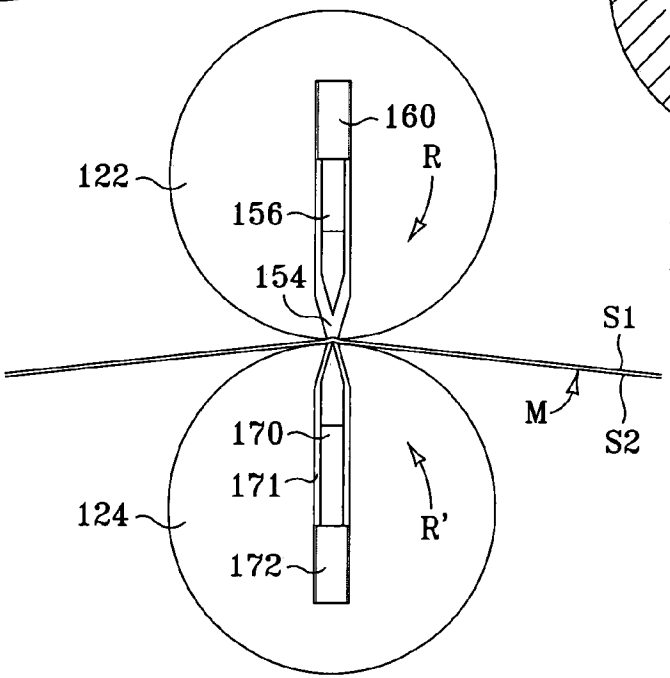
FIG. 6B depicts the rollers of FIG. 6A, but being used to crease or cut a second side of a sheet.
Figure 6A:
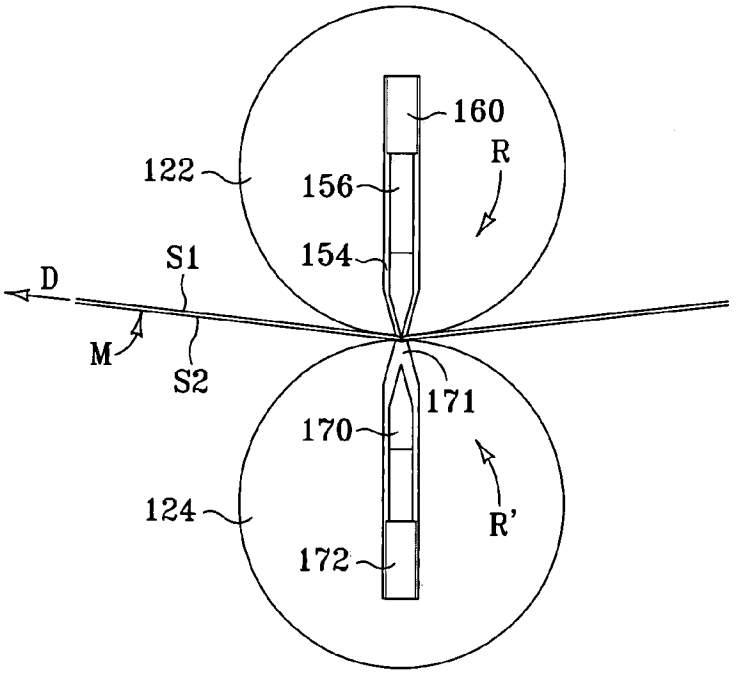
FIG. 6A depicts a side elevation detail of rollers depicted in FIG. 4 which can be used to crease or cut a first side of a sheet, in accordance with the present invention.

Turning now to FIG. 6A, a side elevation view depicts the scoring rollers 122 and 124 of FIG. 4. The second roller 124 can be configured similarly to the first roller 122, as described above. That is, the second roller 124 can comprise a knife 170 which is formed from a second elongated member and is received in an elongated slot 171 in the roller. The knife 170 can be moved from a first position (FIG. 6A) to a second position (FIG. 6B) via a cam 172 and an actuator (not shown). Preferably the first roller 122 and the second roller 124 are positioned essentially parallel to one another, and on opposite sides of the media path (as indicated by the sheet of media "M"). In the example depicted in FIG. 6A, the first knife 156 is deployed to contact the first side "S1" of the sheet of media "M". This results in a first crease (such as along fold line 18 of FIG. 1) being formed in the sheet. As seen in FIG. 6A, the edge of the first knife 156 preferably pushes the sheet "M" slightly into the slot 171 of the second roller 124. This facilitates the formation of a more well defined crease than if the sheet were not pushed into the slot 171. Further, the use of the slot 171 in conjunction with the knife 156 reduces the likelihood that the knife 156 will cut the media, which can occur if the edge of the knife 156 presses the sheet "M" against a fixed object.

As can be seen in FIG. 6B, the second knife 170 can be deployed to contact the second side "S2" of the sheet "M". In this instance the first knife 156 is retracted into the slot 154 of the first roller 122 so that the second knife 170 can preferably push the sheet "M" slightly into the slot 154 of the first roller 122. The action depicted in FIG. 6B results in the formation of a second crease on the sheet (the first crease being formed in the action depicted in FIG. 6A). Preferably, the sheet of media "M" is moved forward in direction "D" (FIG. 6A) between FIGS. 6A and 6B. In this way the sheet "M" can first be scored or creased at a first crease line (intended fold line) on first side "S1", and later creased at a second crease line (intended fold line) on second side "S2". The subsequently creased sheet can then be folded into the shape of the pamphlet 300 depicted in side view in FIG. 12.

Figure 9:
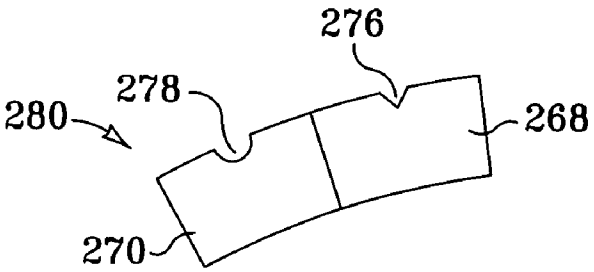
FIG. 9 is a side elevation detail of a cutting and creasing anvil used in the roller of FIG. 8.
Figure 8:
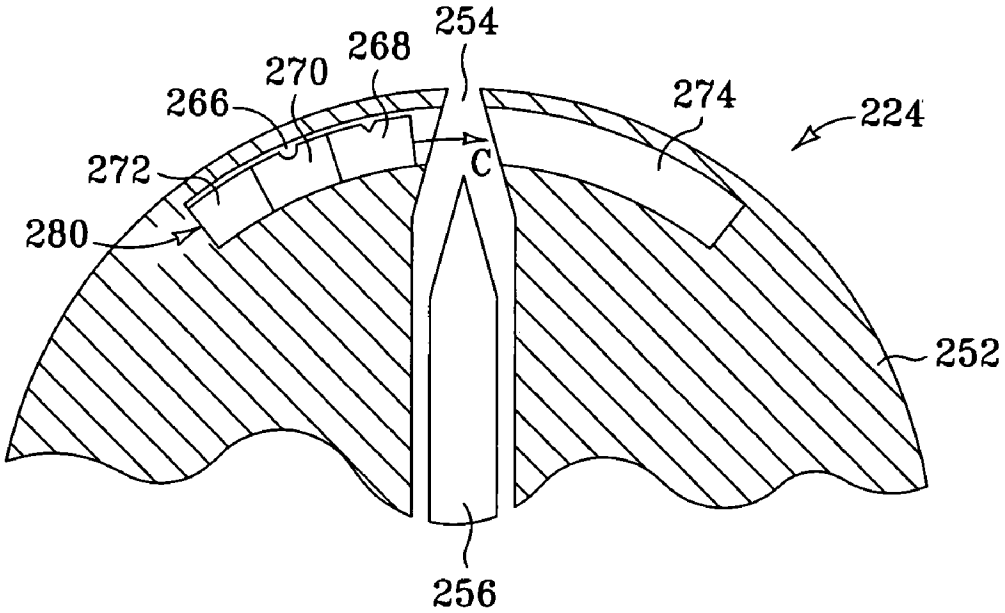
FIG. 8 is a side elevation sectional view of a variation on the roller depicted in FIG. 7.

Preferably, the elongated slot (154, 171, FIG. 6A, and 154, FIG. 7) is relatively narrow at the point where the media is pushed into the slot by the knife in the opposing roller. This facilitates the formation of a more well defined crease in the sheet of media. However, in one variation the slot can be wider, and a surface can be selectively moved into the slot to facilitate processing Of the sheet by a knife located in the opposing roller. For example, turning to FIG. 8, a partial side elevation sectional view of a roller 224 is depicted. The roller 224 can be used in place of either, or both, of the rollers 122 and 124 of FIG. 6A. The roller 224 is configured to be arranged in a complementary set of rollers, as in the configuration depicted in FIG. 6A for rollers 122 and 124. Thus, roller 124 of FIG. 6A can be replaced with roller 224 of FIG. 8, for example. The roller 224 of FIG. 7 includes a knife 256, which can be actuated in a manner similar to the knife 156 of FIGS. 5A and 5B. However, as seen by a comparison of FIG. 7 and FIG. 8, the slot 254 in roller 224 (FIG. 8) is considerably wider at the surface of the roller than is the slot 154 in roller 122 (FIG. 7). Roller 224 further includes an anvil device 280. As shown, the anvil device 280 includes a creasing anvil 266 and a cutting anvil 268. The anvil device 280 is disposed within the roller 224 and is operably moveable in direction "C" from a first position away from the elongated slot 254 to a second position in the elongated slot. The anvil device 280 is operably moveable via cam 272, in a manner similar to movement of blade 156 by cam 160, described above with respect to FIGS. 5A and 5B. When the knife of the opposing roller (not depicted) is in the second or deployed position (as in FIG. 7), the knife edge can selectively contact one of the two anvils 268 or 270. As can be seen by the detail of FIG. 9, the creasing anvil 278 can include a rounded creasing slot 278, allowing the media to be pushed into the slot 278 with reduced risk of cutting the media. On the other hand, the cutting anvil 268 can include a sharply notched cutting slot 276, configured to receive the edge of the knife in a manner intended to sheer a sheet of media placed between the knife and the cutting anvil. When the creasing anvil 270 is disposed in the slot 254 (FIG. 8), then the cutting anvil can be received within an anvil receiving slot 274 in the roller 224. In this way, by adjusting the position of the anvil cam 272, a sheet of media can be selectively either cut or creased by a knife in an opposing roller.

It will be appreciated that the sheet finishing apparatus 100 depicted in FIG. 4 comprises but one example of an apparatus that can be used to implement the methods of the present invention. Generally, the creasing/cutting knives 156 and 170 can be replaced with a "creasing tool", which is any tool, device or apparatus which can be used to form a crease in, or score, a sheet of media. It is not essential that the creasing tool actually physically contact the sheet. For example, the creasing tool can be a laser used to score the sheet. Also, while the apparatus of the present invention preferably allows the sheet to be moved in the media path while being creased or scored, this is not a requirement. For example, the creasing tool can comprise a press used to move a creasing knife towards the sheet of media as the sheet is temporarily paused in the media path. However, preferably the creasing tool is configured to be deployed in a manner which allows forward progress of the sheet within the media path to be continuous.

The creasing tool can be actuated by a "creasing tool actuator", being any device which will cause the creasing tool to form the crease in the sheet of media. For example, if the creasing tool is a knife pressed against the sheet, then the actuator can be a mechanical actuator, such as a cam, or an electro-mechanical actuator, such as a solenoid, a stepper motor, a linear motor, an electromagnet, or any other electro-mechanical positioning device. The actuation of the creasing tool actuator can be selectively performed (such as by a controller), or passively performed (such as by a cam arrangement which periodically actuates the actuator). Certain electro-mechanical actuators allow precise positioning of the creasing tool so that the creasing tool can form a crease in the sheet without cutting the sheet, and can score the sheet without cutting through the sheet. Precision position devices used as the creasing tool actuator also sheets of media of various media thicknesses to be accommodated.

As another example of how the sheet finishing apparatus 100 can be modified, fold rollers (136, 138, 148) do not necessarily need to be used to fold the sheet. For example, the fold rollers can be replaced with a folding plane, such as a hinged metal plate, on which at least a portion of the sheet is placed after the crease is formed in the sheet. The crease can be positioned at a hinged joint in the folding plane so that the folding plane folds the sheet at the crease. Accordingly, it is proper to describe the fold rollers 136, 138, 148 as but one form of a "sheet folding device", being any device which can be used to fold a sheet of media along a crease.

Figure 15:
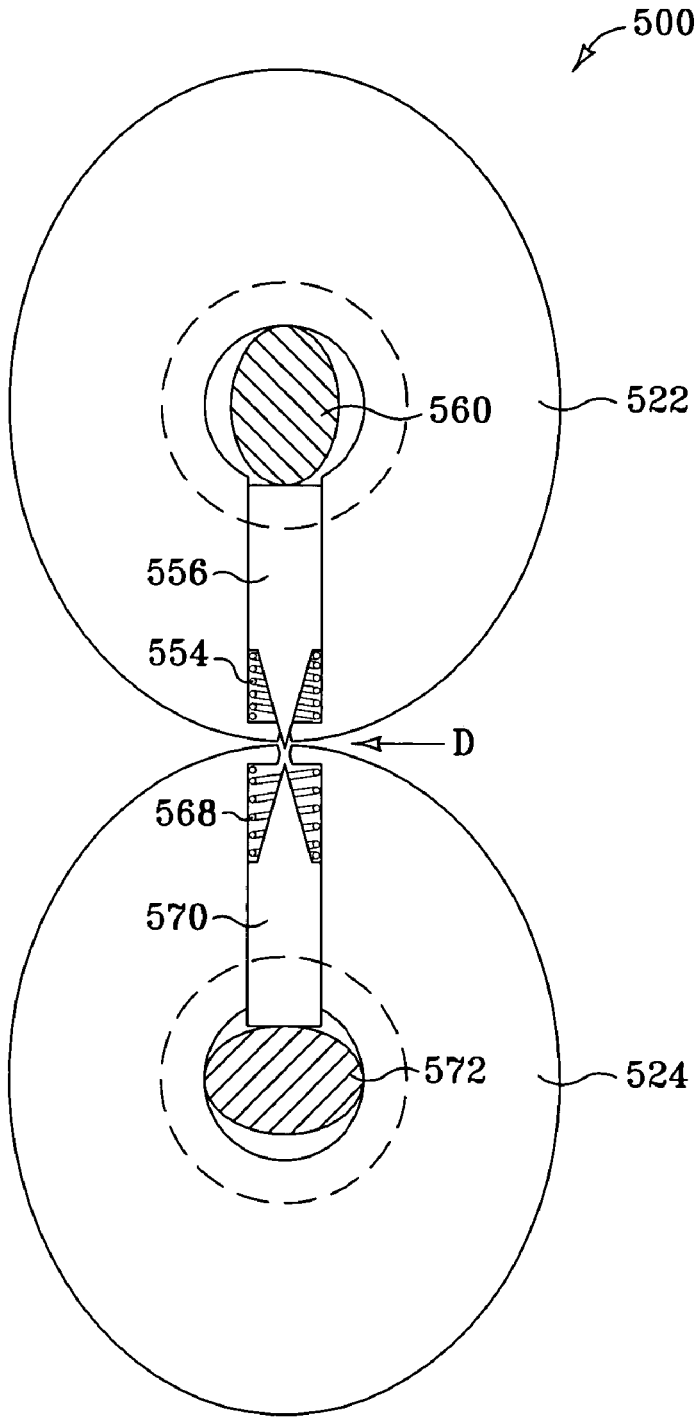
FIG. 15 depicts a side elevation view of another configuration of scoring rollers that can be used to implement the methods of the present invention.

FIG. 15 depicts a side elevation view of one alternate configuration 500 of a pair of scoring rollers 522 and 524 which can be used to implement the methods of the present invention. First scoring roller 522 includes a knife 556 which is biased away from an opening in the roller by spring 554. Likewise, second scoring roller 524 includes a knife 570 which is biased away from an opening in the roller by spring 568. As can be seen, each of the rollers 522 and 524 are eccentric, so that as the rollers rotate in counter-rotating directions, they come together about the media path "D". First roller 522 includes a cam 560 which can be rotated to the position depicted to deploy the first knife 556 to thereby score or crease the first side of a sheet of media moving along the paper path "D". Second scoring roller 524 is likewise provided with a cam 572 which can be used to deploy the knife 570. However, in the position depicted in FIG. 15, cam 572 is positioned such that knife 570 is not deployed. In order to score or crease the second side of the sheet of media, cam 572 can be rotated ninety degrees from the position depicted to thereby push knife 570 into the opening near the surface of the roller 524. When a sheet is not to be scored or creased for folding, then cam 560 can be rotated ninety degrees from the position shown such that knife 556 is in a retracted position. Cams 560 and 572 can be rotated using a solenoid or the like as a knife actuator.

I will now describe, with reference to FIG. 4 and FIGS. 10A through 10J, one example of how the document processing apparatus of FIG. 4 can be used to fold a sheet of media. FIGS. 10A through 10J depict only the sheet finishing apparatus 100 of the document processing apparatus 80 of FIG. 4. In order to simplify the depiction of the operation of the document processing apparatus 100, in FIGS. 10A through 10J the lengths of sections of media "M" passing through the different portions of the apparatus 100 are not to drawn to scale, nor are they consistently depicted in length from figure to figure.

Figure 10B:
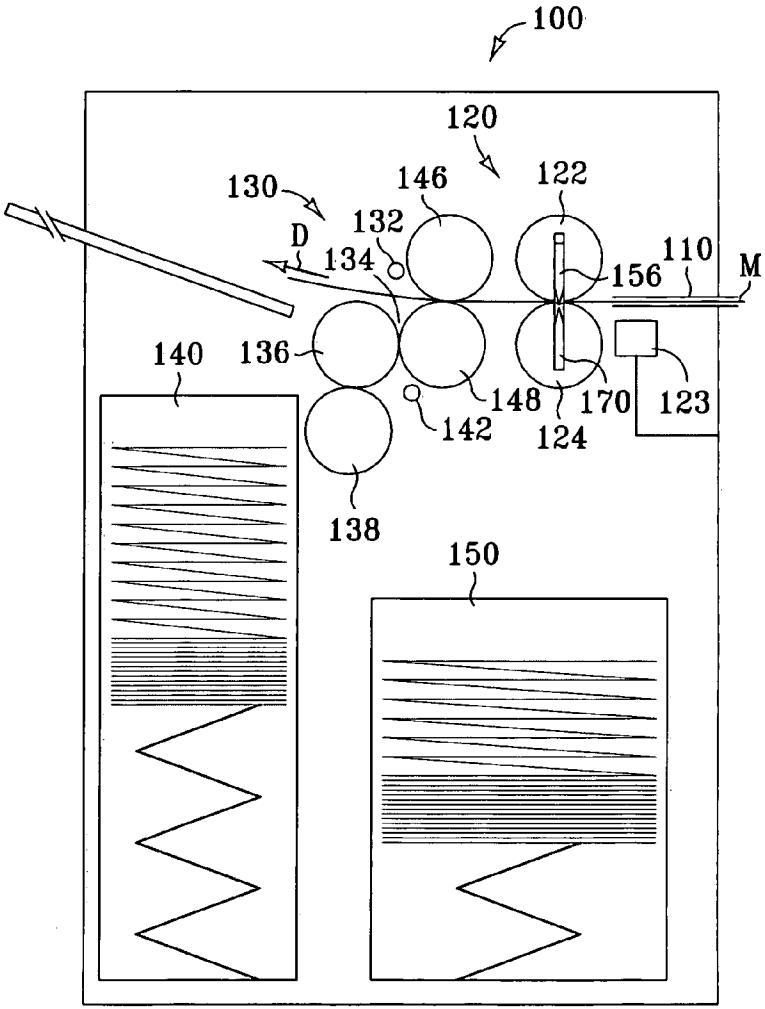
FIGS. 10A through 10J depict a series of steps that can be performed with the apparatus of FIG. 4 to implement the methods of the present invention.
Figure 10A:
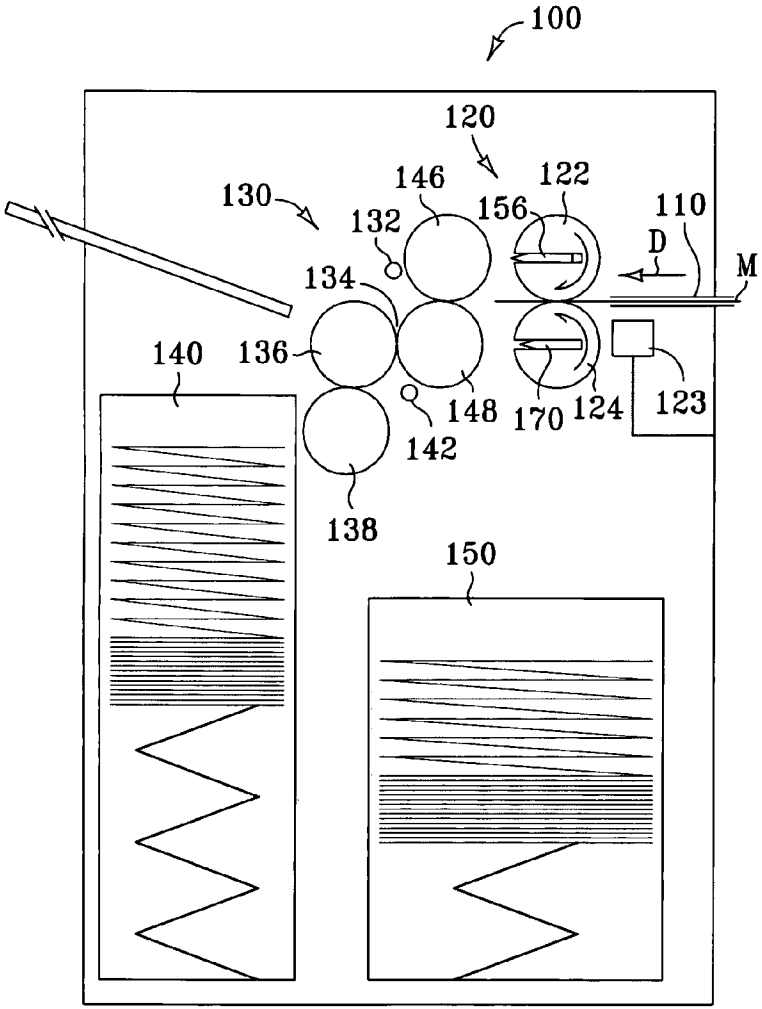

As seen in FIG. 4, the scoring rollers 122 and 124 are slightly retracted away from one another along the paper path "D". In FIG. 10A, the scoring rollers have been brought together. This can be performed using any known device for deploying and retracting rollers, such devices being well understood in the art. In the position depicted in FIG. 10A, roller 122 rotates in a clockwise direction, and roller 124 rotates in a counter-clockwise direction (see respective direction arrows R and R', FIG. 6A). The scoring rollers 122 and 124, along with the drive rollers 146 and 148, move the sheet "M" in direction "D". As shown in FIG. 10B, the first knife 156 contacts the upper side of the sheet "M", forming a first crease in the sheet along a first crease line "C1", which is indicated in FIG. 10C, wherein the sheet "M" has moved further along the media path "D". At FIG. 10D the crease line C1 is aligned with the first pinch roller 132. Preferably, at this point the scoring rollers 122 and 124 are retracted from the media, although this is not a requirement. As also indicated, the first knife 154 has been retracted into the elongated slot in the first roller 122.

Figure 10D:
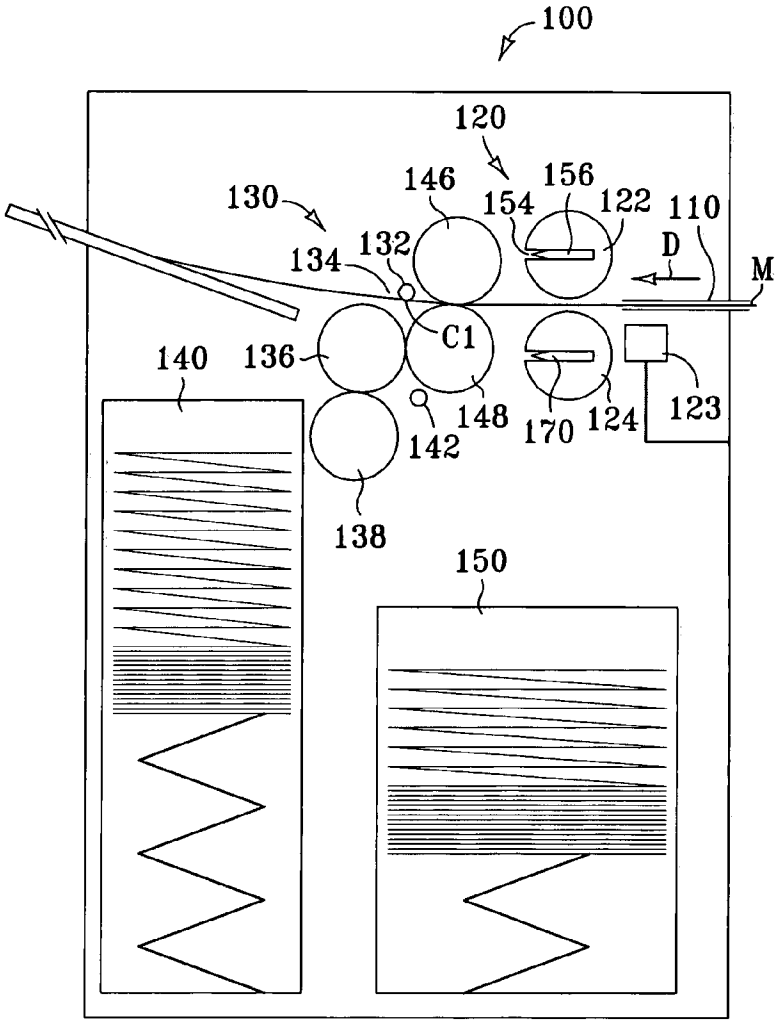
Figure 10C:
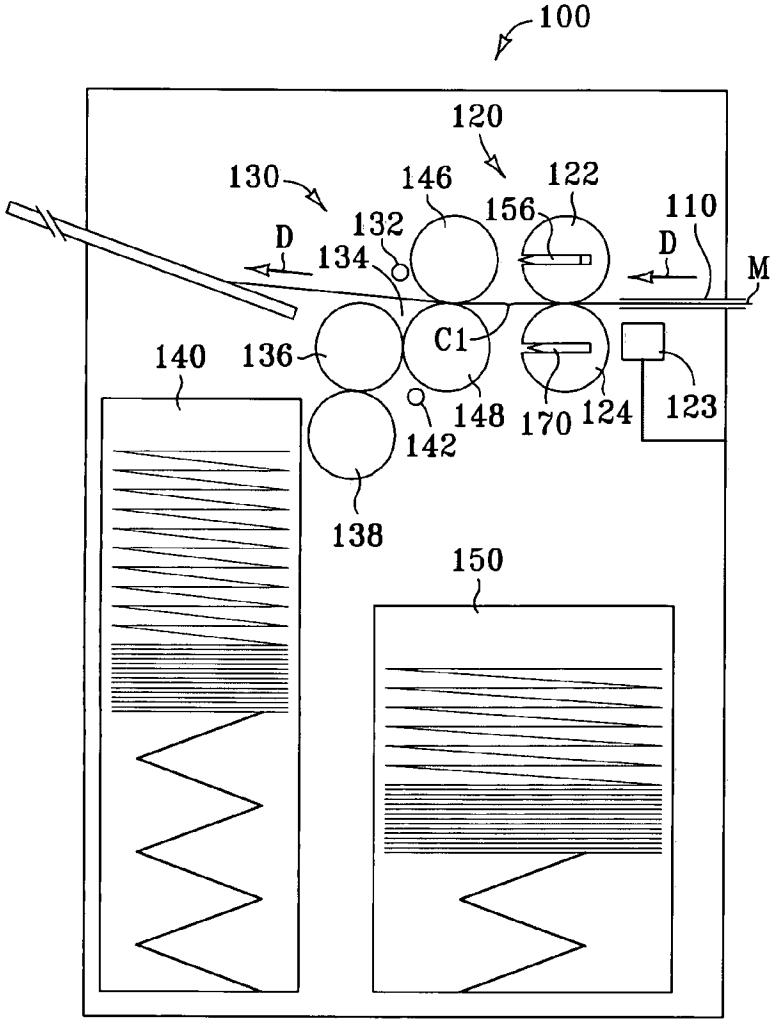
Figure 10F:
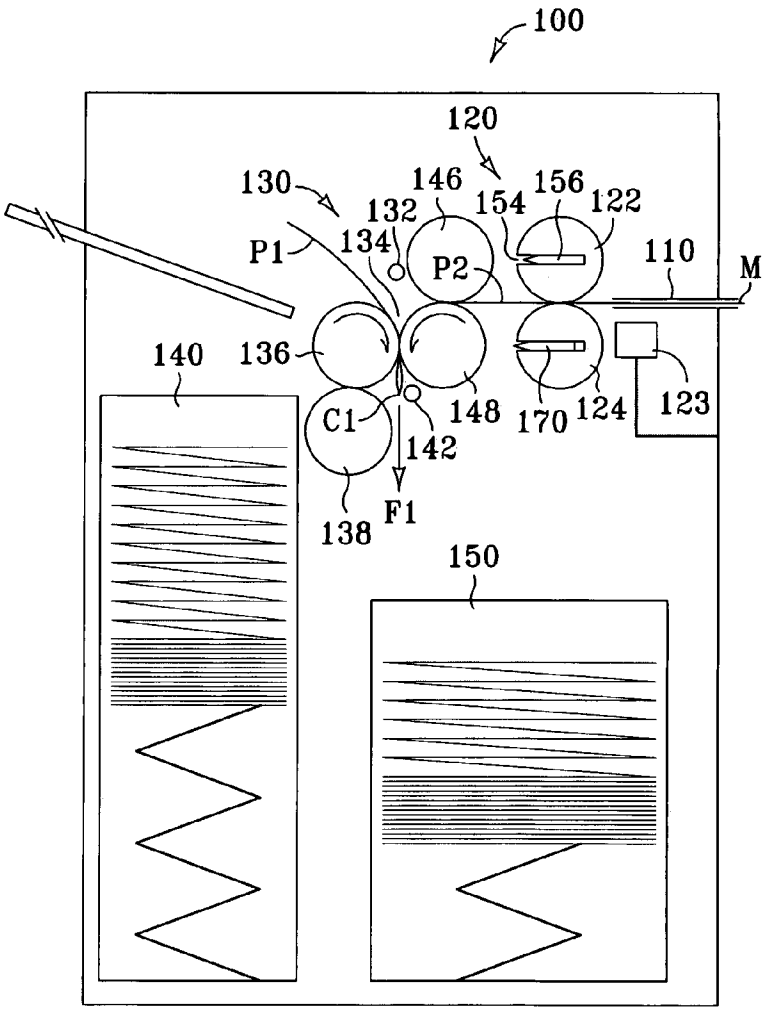
Figure 10E:
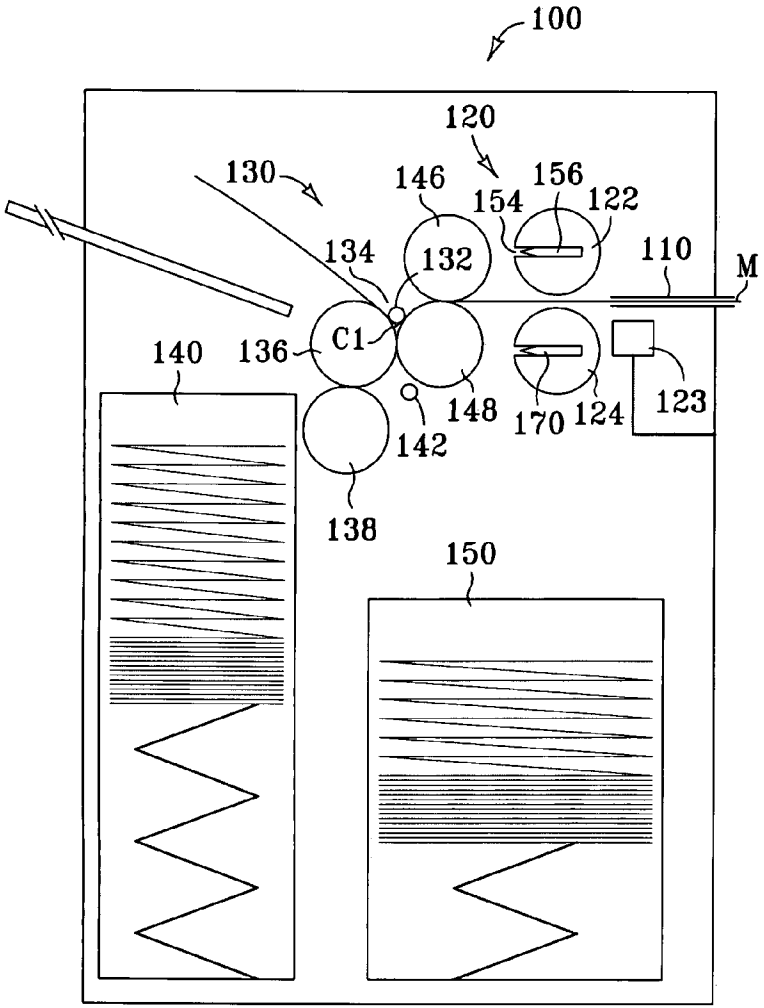

Once the first crease line C1 is aligned with the first pinch roller 132, as indicated in FIG. 10D, the drive rollers 146 and 148 can be stopped to halt forward progress of the sheet of media "M" in the media path, although this is not a requirement, and the process can be continued without halting forward progress of the sheet. At FIG. 10E the first pinch roller 132 is deployed to urge the sheet "M", at the first crease line "C1", into the first nip 134. The first fold rollers 136 and 148 are then rotated in respective clockwise and counter-clockwise directions to grasp the sheet at the first crease line C1, as depicted in FIG. 10F, and move the sheet in direction "F1". This results in the sheet "M" being folded into a first portion "P1" and a second portion "P2" about the crease line "C1. At this point, the fold rollers 136 and 148 can be used to direct the bi-folded sheet "M" into the bi-fold sheet container 150. However, additional folds can also be formed in the sheet, as will now be described.

Figure 10H:
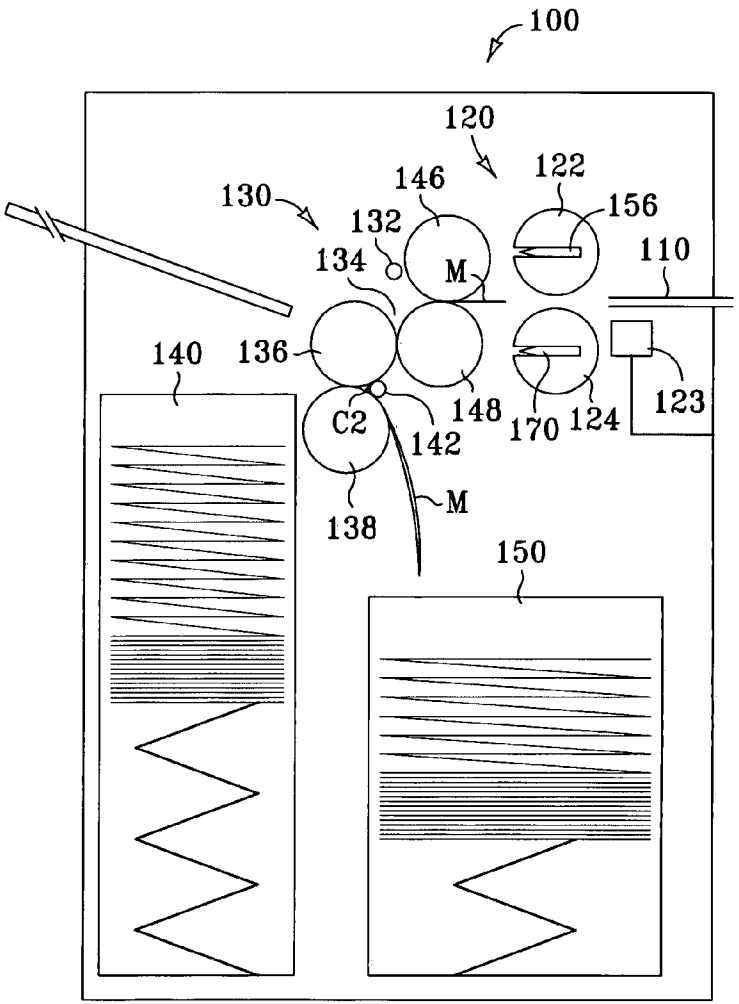
Figure 10G:
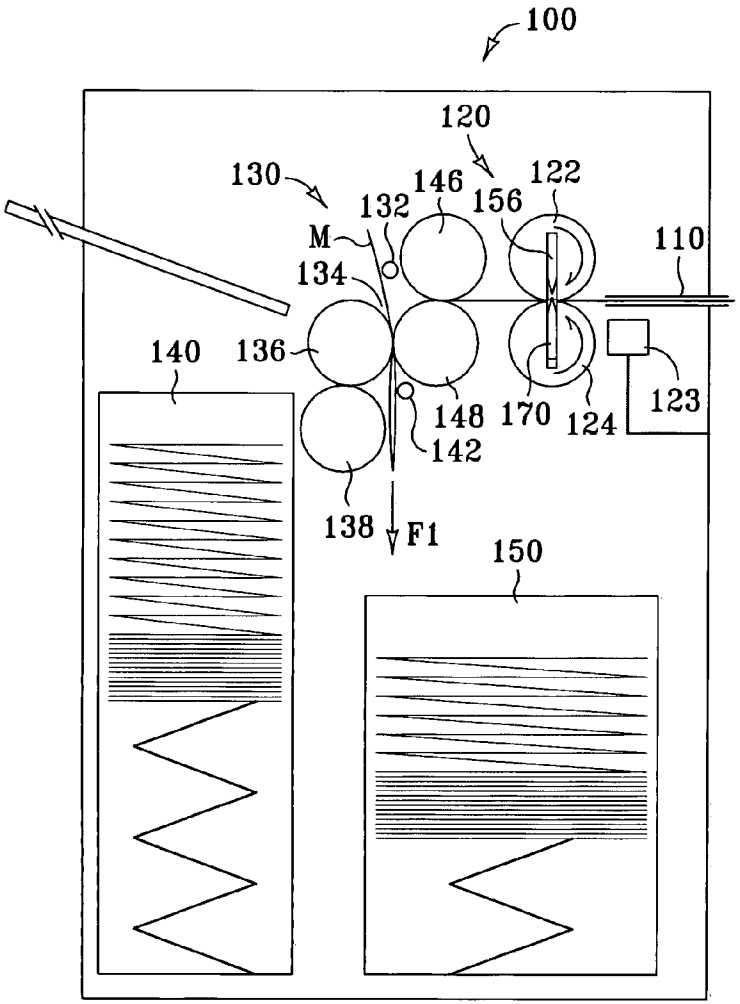
Figure 10J:
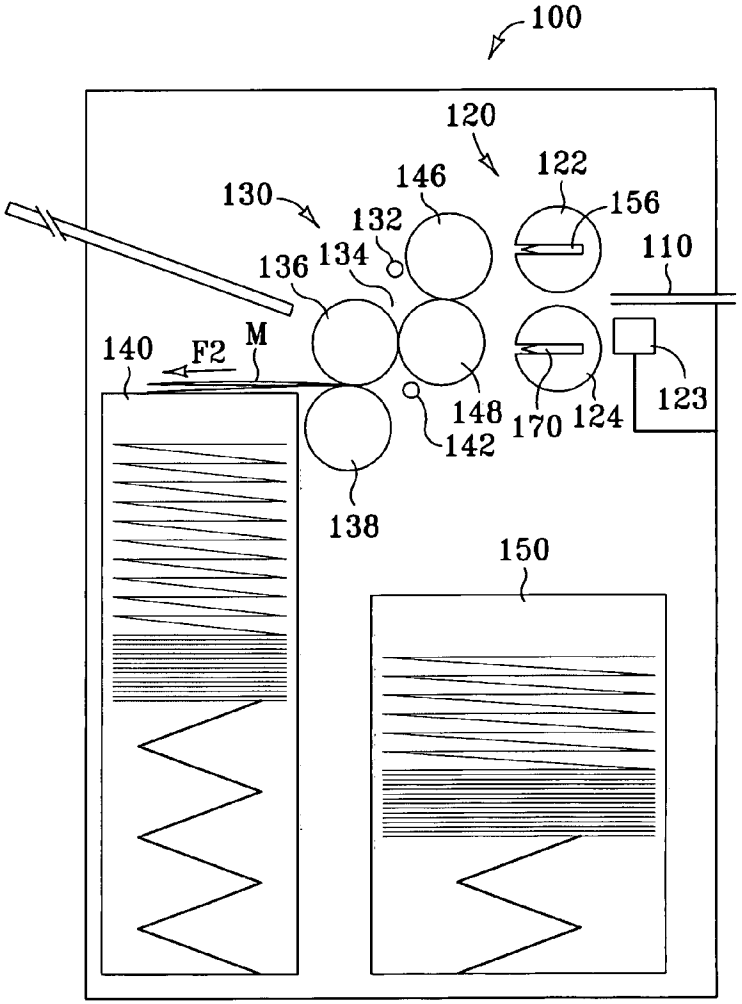
Figure 10I:
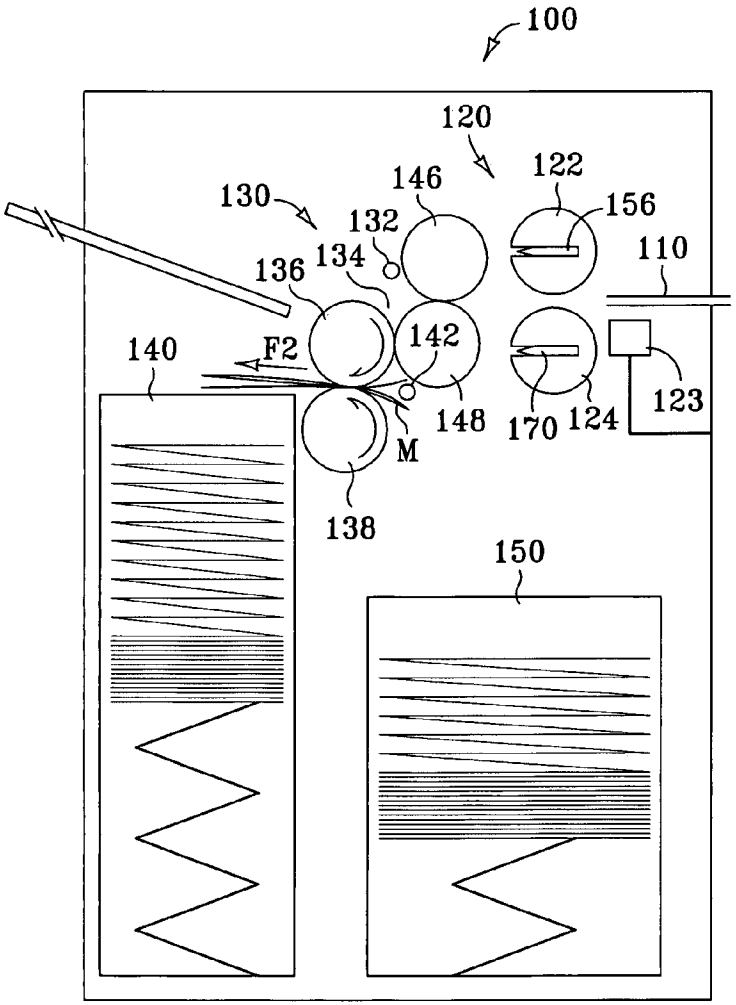
Figure 12:
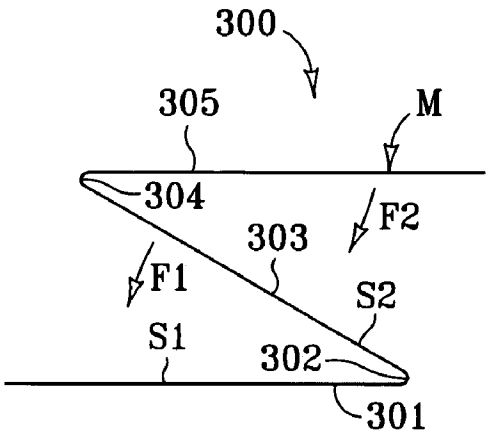
FIG. 12 depicts a side elevation view of a sheet of media being folded into a "Z" shaped pamphlet.

In order to fold the sheet "M" into a tri-fold sheet, such as pamphlet 300 of FIG. 12, at FIG. 10F the second knife 170 in roller 124 is deployed, and the rollers 122 and 124 are brought together about the sheet of media "M". Note that the knife 156 in roller 122 is retracted at this point. The scoring rollers 122 and 124 are then rotated in respective clockwise and counter-clockwise directions to form a second crease along a second crease line "C2" (not shown) in the lower side of the sheet "M" as the sheet is moved forward in the media path, as indicated at FIG. 10G. The second crease line "C2" is then moved, via drive rollers 146, 148 and 136, to a position where the second crease line is aligned with the second pinch roller 142, as depicted in FIG. 10H. At this point the second pinch roller 142 is moved from the position indicated in FIG. 10G to the position shown in FIG. 10H, to thereby urge the second crease "C2" into the second nip 144 between second fold rollers 136 and 138. The second fold rollers 136 and 138 are then rotated in respective clockwise and counter-clockwise directions to grasp the sheet at the second crease line "C2" and move the sheet "M" in direction "F2", as depicted in FIG. 10I. This results in the sheet "M" being folded into a tri-fold pamphlet. For example, at FIG. 12, the pamphlet 300 is folded into a first portion 301 and a second portion 303 by folding the second portion towards the first portion in direction F1 (as in FIG. 10F) at the first crease 304. The third portion 305 of the sheet "M" is then folded towards the first and second portions 301 and 303 of the sheet in the direction "F2" (FIG. 10I) at the second crease 302 to form a Z-shaped tri-fold pamphlet. The pamphlet can then be deposited in the tri-fold container 140, as depicted at FIG. 10J, using rollers 136 and 138.

As can be observed by viewing the sequence of sheet creasing depicted in FIGS. 10A and 10B, at the creasing location (i.e., the location in the sheet finishing apparatus 100 of FIG. 4 where the sheet is creased) the sheet of media "M", and the creasing knife 156, are simultaneously moved to the creasing location. That is, the sheet finishing apparatus 100 allows a sheet of media to be advanced in the media path while simultaneously being creased. This is advantageous since the apparatus does not require forward movement of the sheet to be stopped while the crease is formed, thus reducing the time required to form the folded sheet.

Figure 13:
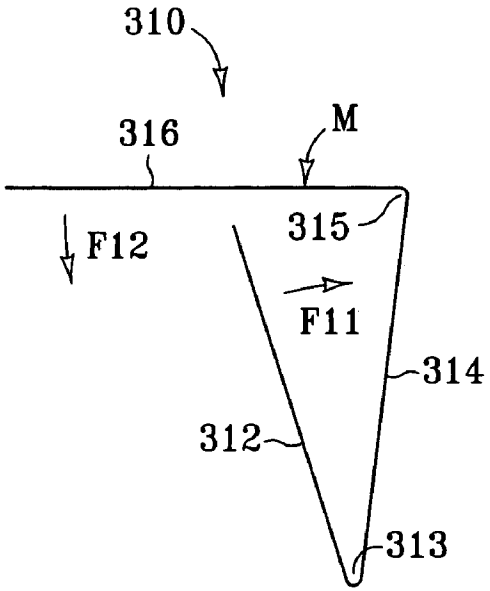
FIG. 13 depicts a side elevation view of a sheet of media being folded into a first form of a "U" shaped pamphlet.
Figure 14:
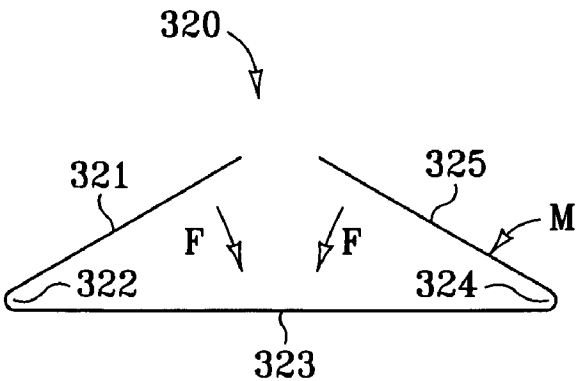
FIG. 14 depicts a side elevation view of a sheet of media being folded into a second form of a "U" shaped pamphlet.

As can be seen, the sheet folding apparatus 100 of FIG. 4 can be used to fold a sheet of media into several different pamphlet shapes. For example, with reference to FIG. 13, a generally "U" shaped pamphlet 310 can also be formed. Specifically, a first crease 313 is formed in the bottom side of the sheet of media "M" as per FIG. 10G. The sheet "M" is then folded about the crease 313 in direction "F11" into a first portion 312 and a second portion, as per FIGS. 10H and 10I. A second crease 315 (FIG. 13) is then formed in the bottom side of the sheet "M", also per FIG. 10G, to thereby define a third portion 316 of the sheet "M" (FIG. 13). The third portion 316 is then folded in direction "F12" (also as per FIGS. 10H and 10I) onto the first and second portions (312 and 314, respectively) to form the final pamphlet 310. In the example depicted in FIG. 13, the three portions (312, 314 and 316) of the sheet "M" are of approximately equal length. A similar process can be used to form the pamphlet 320 of FIG. 14. However, the pamphlet 320 of FIG. 14 has a first portion 321 and a third portion 325 of sheet "M" which are of equal length, while the second portion 323 is twice the length of each of the first and third portions. This can be accomplished merely by changing the location of the creases 322 and 324 along the sheet. Functionally, this can be performed by using the processor 58 and sensors 123 (FIG. 4), along with input from a user (for example, via user input points 65), to identify the locations at which the creases are to be formed in the sheet, and the final desired geometry of the sheet after folds "F" are formed in the sheet "M".

Figure 11:
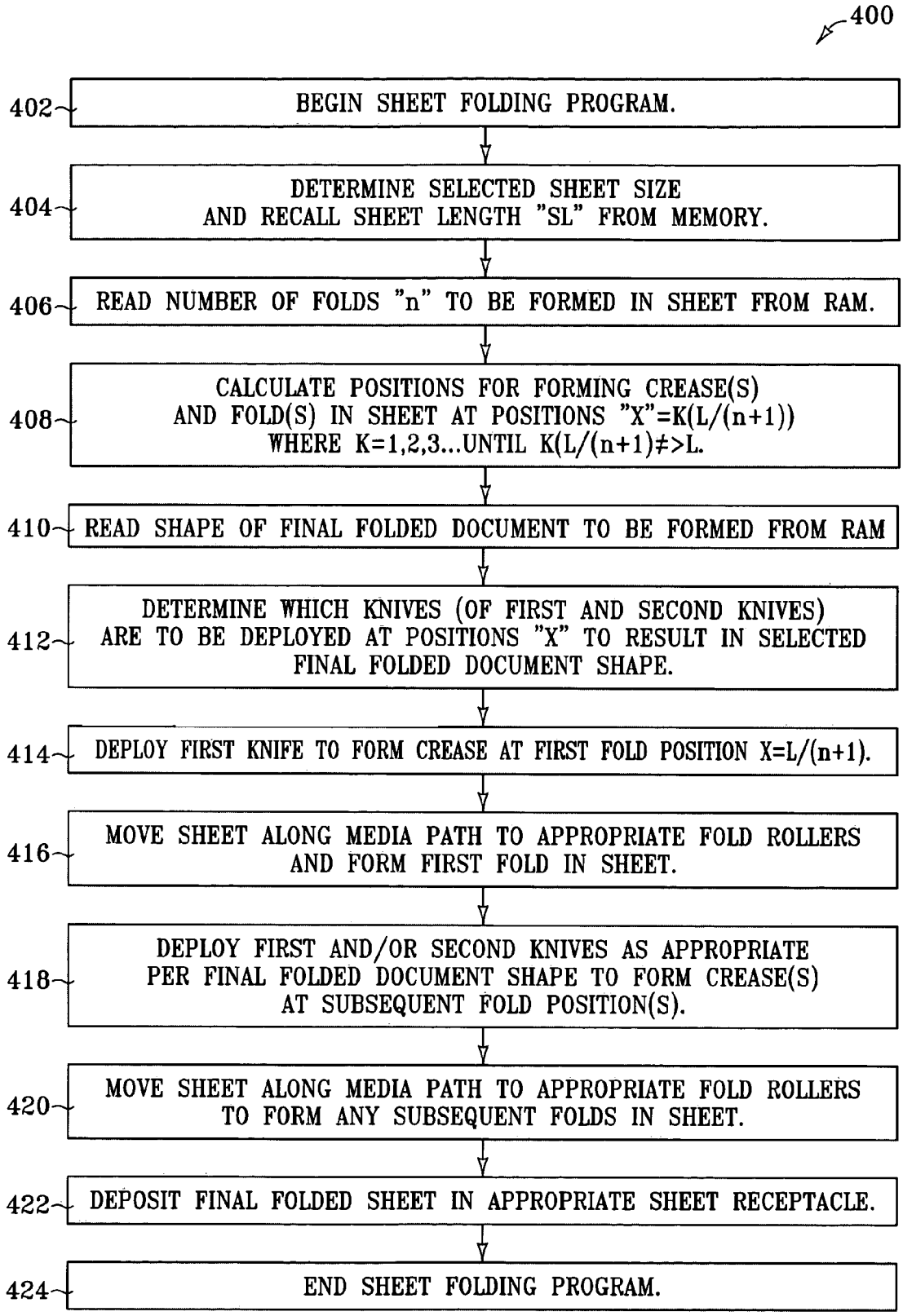
FIG. 11 depicts a flow chart of steps when can be executed to implement one example of an embodiment of the present invention.

To effect essentially automatic implementation of the methods of the present invention, a sheet folding/trimming program (62, FIG. 4) can be used by a processor 58. Specifically, the sheet folding/trimming program 62 can be executed by the processor 58 in order to deploy the knives (156, 170, FIGS. 6A and 6B) and the pinch bars (132, 142, FIG. 4), as well as the activation and non-activation of the drive rollers and fold rollers (146, 148, 136, 138), to crease or score, and fold, a sheet of media. That is, the sequence of knife deployment and roller activation depicted in FIGS. 10A through 10J can be performed automatically, as directed by the sheet folding/trimming program 62 and as executed by the processor 58. FIG. 11 depicts one example of steps of a flow chart 400 which can be reduced to computer executable steps to form the sheet folding/trimming program 62. It will be appreciated that the program 62 can be used only to actuate the sheet creasing tool actuator, and does not necessarily need to also control the folding of the sheet by the sheet folding device. In this case, the program 62 can be described as a "sheet creasing program." However, the following example assumes that the operation of the sheet folding device is also controlled by the program 62.

With respect to FIG. 11, at step 402 a sheet folding program is initiated as directed by a user, via a user console 64 (FIG. 4), or via a computer (not shown) connected to the sheet finishing apparatus 100. When the sheet folding program is not implemented, then a sheet of media is imaged (as for example, by the imaging apparatus 50 of FIG. 4) but is not folded. Assuming, however, that a user desires a sheet of media to be folded, then at step 404 the processor determines the size of the sheet of media (using sensors or the like, or from a user identified sheet size), and recalls a pre-defined sheet length "SL" from a memory device, such as memory 59 of FIG. 4. For example, if a user indicates that the sheet to be used is a size A4 sheet, then the processor can determine that the sheet length is approximately 297 mm in length. Alternately, a user can designate a sheet length "SL" at this point. At step 406 the processor then reads the number of folds "n" to be formed in the sheet. The number of folds "n" is typically designated by a user using an input console, such as console 64 of FIG. 4. This information can be stored in the RAM memory 60 and accessed by the processor 58. This information can also include the final geometry of the folded sheet, as for example indicated by FIGS. 12–14 which indicate three different geometries of tri-folded sheets.

At step 408 the processor determines the positions "K" at which creases (and thus folds) are to be formed in the sheet. This process is performed as long as the positions at which the creases are to be formed is less than, and not equal to or greater than, the length of the sheet. That is, creases are formed at positions X=K (L/(n+1)). For example, if the number of folds "n" to be formed in the sheet is one (1), then K=1, and creases are to be formed a single crease location located at distance X=L/(1+1), or L/2, on the sheet. If two (equidistant) folds are to be formed in the sheet, then n=2, and folds are to be formed at locations X=1 L/(2+1) and X=2 L/(2+1) (i.e., at locations X=L/3 and X=2 L/3). After the crease/fold locations are determined at step 408, then, at step 410, the final shape (geometry) of the folded document is determined by accessing the fold-shape information from the random access memory (60, FIG. 4). The sheet folding geometry can be selected by a user, for example via the input console 64 of FIG. 4. For example, the user can select a simple bi-fold sheet, and can also select in which direction the sheet is to be folded (i.e., folded inwards with respect to a designated side of the sheet, or outwards with respect to a designated side). Likewise, a user can select one of the tri-fold sheet configurations depicted in FIGS. 12–14, or any other folding configuration. The location of the creases/folds (step 408) and the geometry of the final folded document (step 410) will allow the processor (58, FIG. 4) to determine which knives (156 and/or 170, FIG. 6A) are to be deployed, as well as the locations (e.g., C1 (FIG. 10C) and C2 (FIGS. 10G and 10H)) at which the knives are to be deployed, as initiated at step 412.

At step 414 the first knife (as determined by the fold geometry at step 412) is deployed to form the first crease at fold location X=K (L/(n+1), as described above. The sheet of media is then moved along the media path at step 416 to the appropriate fold roller (e.g., rollers 136 and 148 of FIG. 4), and the first fold is formed in the sheet, as described above with respect to FIGS. 10A through 10F. Subsequent folds (if any) are formed in the sheet by first the creasing the sheet with the appropriate knife (step 418) and then using the appropriate fold rollers to form the fold (step 420). The final folded sheet is then deposited in the appropriate sheet receptacle at step 422, and the sheet folding program ends at step 424.

It is understood that the flow chart 400 depicted in FIG. 11 is exemplary only, and that additional or different steps can be used to equal effect. It will also be appreciated that, depending on the selected geometry of the final folded sheet, and the spacing of the scoring rollers (122, 124, FIG. 4) with respect to the pinch rollers (132, 142) and the fold rollers (136, 138, 148), the steps of the flowchart 400 (FIG. 11) can be performed in a different order than that depicted. For example, step 416 in FIG. 11 indicates that the first fold is formed prior to making the next crease at step 418. However, if the next crease is formed by the scoring rollers before the first crease has advanced to the first pinch roller (132), then step 418 ("form next crease") will be performed before step 416 ("make first fold").

The present invention also provides a method of automatically folding a sheet of media. The method includes forming a first crease on a sheet of media along a first crease line. The first crease defines first and second portions of the sheet. For example, with respect to FIG. 12, a first crease line 302 defines the sheet of media "M" into a first portion 301, and a second portion comprised of portions 303 and 305. In the method, the sheet is next urged towards a nip (such as nip 134, FIG. 4) by pressing the sheet of media essentially along the first crease while supporting the first and second portions of the sheet. This step is similar to the step depicted in FIG. 10E wherein the first pinch roller 132 is urging the sheet "M" towards the nip 134 between rollers 138 and 148. At the nip, the sheet is grasped at essentially the first crease line, and the first portion of the sheet is urged towards the second portion of the sheet. This step can be performed as indicated in FIG. 10F, wherein the fold rollers 136 and 148 are used to fold the sheet into the two portions along the crease line. The method can further comprise, prior to forming the first crease, heating the elongated creasing member.

The method can further include forming a second crease on the sheet of media along a second crease. The second crease line thus defines a third portion of the sheet defined by the second crease line. For example, the sheet of media "M" in FIG. 12 is creased along second crease line 304 to thereby define the third portion of the sheet 305. The sheet is then urged towards a second nip (e.g., nip 144, FIG. 4) by pressing the sheet of media essentially along the second crease while supporting at least one of the first and second portions of the sheet (see for example FIG. 10H), and also supporting the third portion of the sheet. At the second nip, the sheet is grasped at essentially the second crease line and the third portion of the sheet is urged towards the first and second portions of the sheet (see for example FIG. 10I). In this way a tri-fold sheet, such as any of the sheets "M" depicted in FIGS. 12, 13 and 14, can be formed.

The geometry of the final folded sheet will dictate which side (or sides) of the sheet are to be scored or creased, and the particular components of the folding device (130, FIG. 4) to be employed to form the final folded sheet. For example, in order to form a "Z" folded sheet, such as sheet 300 of FIG. 12, the first crease 302 can be formed by pressing a first elongated member (such as knife 156, FIG. 6A) against the first side ("S1", FIG. 12) of the sheet "M", and the second crease 304 is formed by pressing a second elongated member (such as knife 170, FIG. 6A) against the second side of the sheet. This corresponds to the sequential steps depicted in FIGS. 6A and 6B.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A document processing apparatus, comprising:

a media path;

a first roller disposed proximate the media path;

a knife defined by an edge and supported by the first roller, wherein the edge is selectively extendable from the first roller;

a second roller having an elongated slot formed therein and disposed proximate the first roller such that a sheet of media moving along the media path passes between the first roller and the second roller; and, a cutting anvil disposed within the second roller and operably moveable along path substantially transverse relative to the elongated slot from a first position in which the cutting anvil is withdrawn from the slot to a second position in which the anvil is exposed within the slot.

2. The document processing apparatus of claim 1, and further comprising a creasing anvil disposed within the second roller and operably moveable from a first position in which the creasing anvil is withdrawn from the elongated slot to a second position in which the creasing anvil is exposed within the elongated slot.

3. The document processing apparatus of claim 1, and wherein the first roller further comprises a cam disposed within the elongated slot and in contact with the knife, the cam configured to slidably move along a portion of the length of the first roller and thereby operably move the knife from the first position to the second position.

4. The document processing apparatus of claim 1, wherein the anvil path is substantially defined by an anvil receiving slot contained within the second roller.

5. The document processing apparatus of claim 1, wherein the anvil path is substantially arcuate and substantially concentric relative to the second roller.

6. A document processing apparatus, comprising:

a media path;

a roller disposed proximate the media path;

an elongated slot defined by the roller;

a knife defined by an edge and supported within the elongated slot; and an anvil device disposed within the roller and operatively movable between an exposed position in which the anvil device is in substantially juxtaposed registered alignment with the slot and a withdrawn position in which the anvil device is not in substantially juxtaposed registered alignment with the slot, wherein:

the knife is movable between a retracted position and an extended position; and, movement of anvil device into the exposed position is substantially blocked by the knife when the knife is in the extended position and substantially unblocked when the knife is in the retracted position.

7. The document processing apparatus of claim 6, wherein movement of the knife to the extended position is substantially blocked by the anvil device when the anvil device is in the exposed position.

8. The document processing apparatus of claim 6, wherein the anvil device is movable between the exposed position and withdrawn position along a path transverse to the slot.

9. The document processing apparatus of claim 6, wherein the anvil device comprises a cutting anvil.

10. The document processing apparatus of claim 9, wherein the cutting anvil defines a notched cutting slot.

11. The document processing apparatus of claim 6, wherein the anvil device comprises a creasing anvil.

12. The document processing apparatus of claim 11, wherein the creasing anvil defines a rounded creasing slot.

* * * * *

UNITED STATES PATENT AND TRADEMARK OFFICE

CERTIFICATE OF CORRECTION

PATENT NO. : 7,090,631 B2
APPLICATION NO. : 10/764767
DATED : August 15, 2006
INVENTOR(S) : Roland Boss It is certified that error appears in the above-identified patent and that said Letters Patent is hereby corrected as shown below:

In column 14, line 27, in Claim 1, after “along” insert -- a --.

Signed and Sealed this

Twenty-fourth Day of February, 2009

JOHN DOLL
*Acting Director of the United States Patent and Trademark Office*